United States Patent [19]

Fuhrer

[11] Patent Number: 4,606,168

[45] Date of Patent: Aug. 19, 1986

[54] SUSPENDED INSULATED BUILDING EXTERIOR CLADDING

[76] Inventor: John P. R. Fuhrer, R.R. #5, Bolton, Canada

[21] Appl. No.: 676,481

[22] Filed: Nov. 29, 1984

[51] Int. Cl.[4] ..... E04B 1/62; E04B 2/04

[52] U.S. Cl. ..... 52/741; 52/410; 52/443; 52/713; 52/714

[58] Field of Search ..... 52/361-363, 52/334, 366, 410, 454, 741, 714, 713, 443; 411/531, 545, 544

[56] References Cited

U.S. PATENT DOCUMENTS

| | | | |
|---|---|---|---|
| 1,169,641 | 1/1916 | Hedden | 52/363 |
| 1,859,779 | 5/1932 | Lee | 52/363 |
| 2,024,068 | 12/1935 | Shannon | 52/362 |
| 2,309,420 | 1/1943 | Taylor | 52/714 X |
| 3,389,518 | 6/1968 | Horbach | 52/309.17 X |
| 4,044,520 | 8/1977 | Barrows | 52/309.12 |
| 4,315,258 | 3/1982 | Heck | 52/453 |

FOREIGN PATENT DOCUMENTS

| | | | |
|---|---|---|---|
| 236934 | 12/1961 | Australia | 52/309.1 |
| 598467 | 5/1960 | Canada | 52/443 |
| 1148324 | 6/1983 | Canada | 52/410 |
| 682956 | 10/1939 | Fed. Rep. of Germany | 52/363 |
| 3045986 | 6/1982 | Fed. Rep. of Germany | 52/410 |
| 1999 | of 1908 | United Kingdom | 52/443 |

*Primary Examiner*—Alfred C. Perham
*Attorney, Agent, or Firm*—Sim & McBurney

[57] ABSTRACT

A suspended insulated cladding system is applied to building exterior. The method for applying the system comprises affixing a plurality of batts of semi-rigid vapor permeable fibrous insulation to the existing building exterior surface. Each of the fasteners used in affixing the insulation batts to the building exterior has an enlarged plate portion associated with the fastener. Each enlarged plate includes a plurality of apertures extending through it. A layer of cementitious material is applied over the batts and forced through the apertures in each plate of the fastener. The cementitious layer is allowed to harden over which a vapor permeable finish coat is applied. A sufficient number of fasteners are used to suspend the hardened cementitious layer from the building exterior surface.

9 Claims, 5 Drawing Figures

SUSPENDED INSULATED BUILDING EXTERIOR CLADDING

FIELD OF THE INVENTION

This invention relates to systems for cladding the exterior of a building.

BACKGROUND OF THE INVENTION

It is often necessary to refurbish building exterior due to a variety of reasons, such as aging, cracking of the existing surface structure, updating of the building exterior to name only a few. Several approaches have been taken in providing a new exterior to an existing building, such as using prefab panels which are affixed to the building wall and other surfaces, or the application of a stucco finish to the building exterior.

Horbach, U.S. Pat. No. 3,389,518, discloses an approach which provides a continuous finish to the building exterior when completed. To the building exterior, a form of cellular insulation is applied by use of adhesives. A continuous layer of cementitious material is applied over the cellular insulation and reinforcement in the form of glass fibre fabric or reinforcing fibres is incorporated in the cementitious material. A finish coat of synthetic materials, such as propionic acid ester or other binder materials, is applied to the cementitious layer. The finish coat may include a mineral aggregate for decorative purposes. The purpose of this structure is to prevent crack propagation in the building wall being transmitted to the newly completed surface, thereby preventing crack formation in the new finish. Horbach refers to use of steel plates on the face of the insulation to protect the cellular insulation material. He does not recommend the use of such steel plates because of heat conductivity and that due to their exceptional weight, they have to be firmly secured to the building exterior and cannot compensate for temperature variations that can form cracks in the surface of finish material applied to the insulation.

Heck, U.S. Pat. No. 4,318,258, discloses improvements in the use of Styrofoam (trademark) panels which are affixed to building walls. The insulation panelling has a special grooving arrangement to compensate for expansion and contraction in the panels. A cement layer is applied over top of the foam layers. The plaster or mortar may contain synthetic resins, such as methyl cellulose and polyvinyl propionate. Other suitable plastic resins include homo- polymers, copolymers of acrylic acid and methacrylic acid, e.g. styrol acrylates and vinyl acetates. The foam slabs as grooved are glued to the building exterior in a manner similar to that discussed in Horbach, U.S. Pat. No. 3,389,518.

A comparable system involving the use of Styrofoam panels is disclosed in Canadian Pat. No. 1,148,324. The Styrofoam panels having grooves on the interior and the exterior are applied to a building wall using fasteners. The base coat of plaster or mortar is applied over the Styrofoam panels where the cementitious material is received in the outer grooves of the Styrofoam panels to ensure that the hardened base coat material is firmly affixed to the Styrofoam material. When the styrofoam material moves due to expansion and contraction caused by temperature extremes, cracking in the base coat occurs.

Burrows, U.S. Pat. No. 4,044,520, discloses a building panel system which is a modular unit glued to the building exterior. Each building panel as preformed consists of a foamed resin insulation layer over which a base coat and finish coat are applied. A polymer fortified concrete base coat may be used. Polymer fortification of the cement may be provided by an acrylic polymer together with a defoaming agent. The outer facing layer may be of a synthetic binder material, such as an acrylic polymer optionally used in combination with concrete. Aggregate may be added to the binder material to enhance the appearance of the building panels. These individual preformed panels have edge portions formed in a manner so that, when the panels are glued to the building exterior, the edges overlap in a mating manner to provide a modular type exterior finish for the building. The unfortunate problem with this system is that, if the building exterior is of uneven plane, then the panels as applied to the building exterior also take on the uneven plane of the building.

Another form of prefabricated building panel is disclosed in Australian Pat. No. 236,934. A prefabricated panel, according to this patent, consists of gluing together a mechanically resisting plate or slab and a heat and sound insulating layer. The building panel is impermeable to moisture, which can cause a problem when applied to building exteriors because moisture vapor should be allowed to freely diffuse into and out of the cladding applied to the building exterior.

SUMMARY OF THE INVENTION

According to an aspect of the invention, a method for applying a suspended insulated building exterior cladding system comprises affixing a plurality of batts of semi-rigid, vapor permeable, fibrous insulation over an existing building exterior surface. The plurality of batts abut one another as applied to provide an essentially continuous insulated layer on the building exterior surface. The step of affixing the plurality of batts comprises the use of fasteners extending through each of the insulated batts to secure each batt to the building exterior surface. Each of the fasteners is firmly secured to the building exterior surface and is of sufficient length to preclude over compression of each of the batts. The fastener head portion has a rigid plate associated therewith, where the rigid plate includes a plurality of apertures extending therethrough. Over the insulation batts is applied a continuous layer of cementitious or like material which hardens when set. During the application, the cementitious material is forced through the apertures in the plates of each of fasteners. The cementitious layer is allowed to harden and a vapor permeable finish coat is then applied over the cementitious layer which also, when hardened, is vapor permeable. In the step of affixing the plurality of batts, a sufficient number of fasteners are used to suspend the hardened cementitious layer from the building exterior surface.

According to another aspect of the invention, a suspended insulated building exterior cladding system comprises a plurality of batts of semi-rigid, vapor permeable, fibrous insulation affixed to a building exterior surface. The batts abut each other as affixed to the building exterior. A plurality of fasteners for securing the batts to the building exterior are used. Each of the fasteners extends through the insulation batt and is secured to the building exterior. The fastener has a head portion to which a rigid plate is associated. The rigid plate has a plurality of apertures extending therethrough. Each of the fasteners is applied to contact each batt with the building exterior and avoid over compression of the batt. A vapor permeable, continuous hardened cementitious base layer covers the batts. The cementitious material extends through the apertures in the rigid plate of each fastener. A vapor permeable finish coat is applied over the base layer. A sufficient number of fasteners are used in affixing the batts to the building exterior to suspend the hardened base layer and finish coat from the building exterior.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
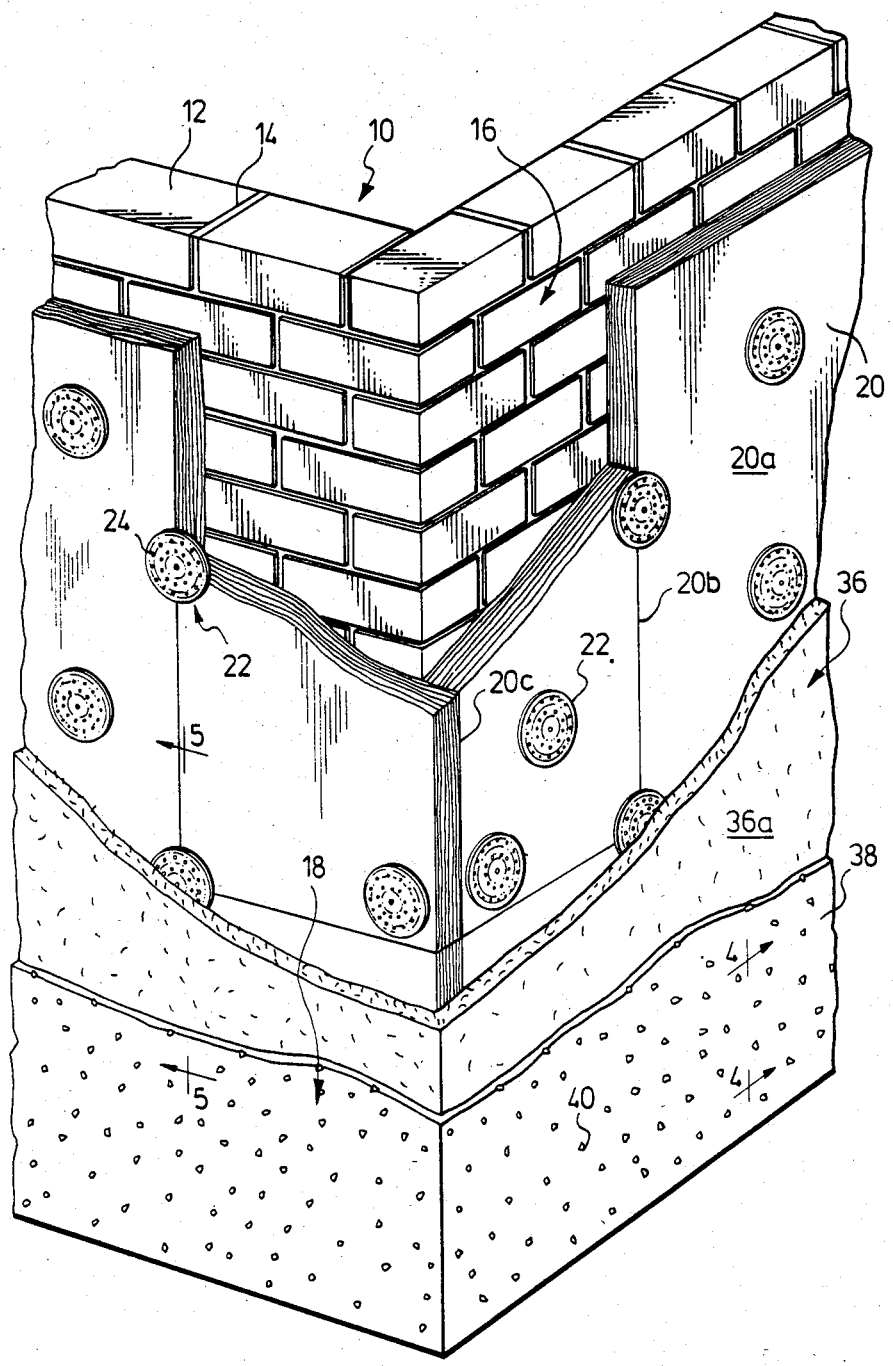
FIG. 1 is a perspective view showing the cladding system for a pre-existing building exterior.

The wall cladding system, according to this invention, can be applied to a variety of types of pre-existing building exteriors, such as wood, metal, brick, block to name only a few. As shown in FIG. 1, a building has a pre-existing wall 10 consisting of bricks 12 secured in place with mortar 14. To the building exterior generally designated 16, the wall cladding system 18 is applied.

Figure 2:
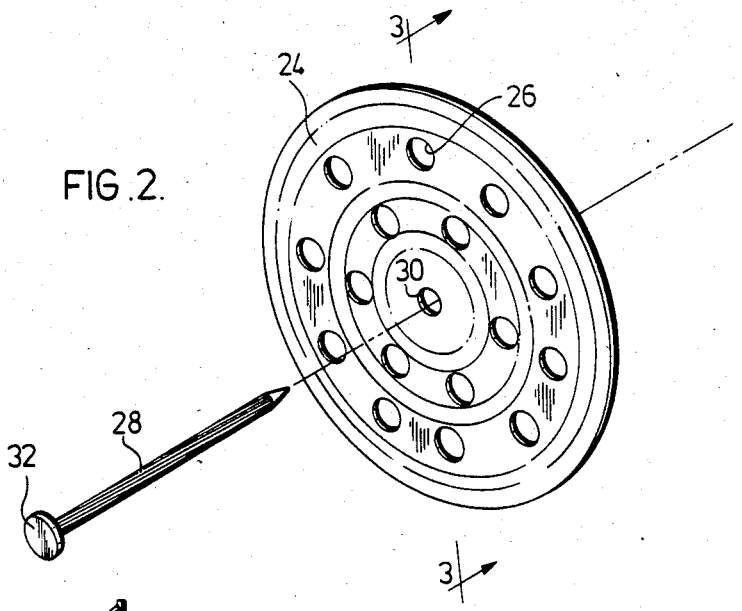
FIG. 2 is an exploded view of the fastener for the insulation batts.
Figure 3:
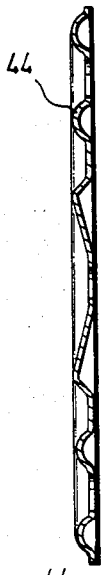
FIG. 3 is a section along the lines 3—3 of FIG. 2.

The wall cladding system consists of a layer of insulation 20 which is in the form of individual batts. The insulation is of the fibrous type and is semi-rigid so that when handled, it retains essentially its rectangular shape to facilitate application to the wall. The fibrous insulation batts 20 are affixed to the building exterior 16 by the use of fastener devices 22 where each fastener has associated therewith a rigid plate 24 having a plurality of apertures 26, as shown in more detail in FIG. 2. The fasteners 28, according to this embodiment, are steel nails which pass through the central aperture 30 of the plate 24. The nail head 32 is larger than the aperture 30 to thereby draw the interior surface generally designated 34 in FIG. 3 against the exterior surface 20*a* of each fibrous insulation batt. Several fasteners 22 are used in affixing the fibrous batts to the building exterior 16. Once the batts of insulation are in place, which abut each other at their edges designated at 20*b* and overlap at the corners such as at 20*c*, an essentially continuous face of insulation is provided.

A cementitious layer generally designated 36 is applied to the face 20*a* of the insulation. The cementitious layer or like substance is normally hand applied, although it may be machine applied such as by spraying techniques. When trowelled by hand, the uneven surfaces of the insulation layer face 20*a* can be compensated for so that the exterior surface 36*a* of the cementitious layer is essentially level across its face. In applying the cementitious layer at each fastener plate 24, pressure is applied to force the cementitious material through the apertures 26 of each plate so that when the layer hardens, the layer is then secured to each plate 24. Once the base coat, in the form of the cementitious layer 36 is hardened, the exterior coating surface 38 may be applied. The outer finish coat may be paint or the like, or it can be a synthetic binder material having aggregate particles 40 therein to provide a decorative finish.

Figure 4:
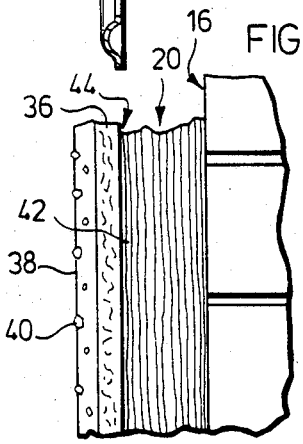
FIG. 4 is a section along the lines 4—4 of FIG. 1.
Figure 5:
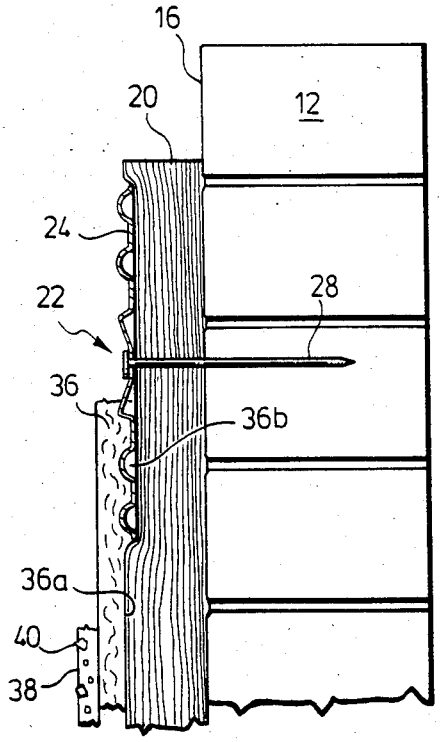
FIG. 5 is a section along the lines 5—5 of FIG. 1.

As shown in the section of FIG. 4, the fibrous insulation layer 20 is compressed against the building exterior 16 by use of the fasteners 22 in various areas as demonstrated in FIG. 5. The compression of each insulation batt 20 is minimal over which the cementitious layer 36 is applied and as shown, the cement 36*b* penetrates through the apertures 26 of the plate 24 to secure the hardened layer 36 to these plates. The nail fasteners 28 penetrate the building wall bricks 12 and firmly secure the fasteners in place and thereby support the perforated plate portions. On hardening of the base coat 36, the fasteners 28 serve to suspend the outer hardened cladding portion from the building exterior bricks 12. This permits movement of the fibrous insulation layer 20 relative to the outer hardened wall portion 36. As shown in FIG. 4, the fibrous batt 20 may become detached such as at 42 from the hardened material 36. This results from movement of the fibrous insulation at the interface generally designated 44 between the fibrous material 20 and the hardened layer 36. Due to vapor diffusing either from outside of the wall cladding system or from within the building pre-existing wall, the insulating layer 20 may expand and contract without affecting the outer hardened layer 36 as suspended from the building wall. Thus the fasteners 28 serve to support vertically in a cantilevered manner the building wall exterior cladding in the form of the hardened cementitious layer 36 and the outer finish coat 38. It is appreciated that the same system may be used covering exposed horizontal building surfaces, such as basement ceilings.

The plate 24, as associated with the fastener according to this preferred embodiment, is circular and has a plurality of concentric ridges 44. The concentric ridges in combination with the apertures provide an irregular surface to which the hardened cementitious material can readily attach itself and by way of the firmly affixed fasteners serve to suspend the outer cladding layer from the building wall 16. As shown in FIG. 5, there is minimal compression of the fibrous insulation batt 20 to thereby maintain the insulation properties of the batt. Once the fibrous batt has served the purpose of providing a continuous face to which the cementitious layer is applied, the batt, due to its fibrous construction, is permitted to shift due to expansion and contraction forces caused by external forces, such as building shift and extremes in temperature. In turn the insulation can become detached from the interior face 36*a* as shown in FIG. 5 in developing the spaces 42 as shown in FIG. 4.

The fibrous insulation batts may be developed from an assorted form of natural and synthetic fibres. For example, the fibrous batt may be of Fiberglas (trademark) insulation in the form of a fine fibered, shock-free insulation board which is semi-rigid and of controlled density and thickness which is bonded by a thermosetting resin to give it the semi-rigid form of structure for application to the building exterior and at the same time providing a surface to which the cementitious material may be conveniently manually or machined applied. The thickness of the insulation Fiberglas compressed batts may range from one to four inches depending upon the application. The Fiberglas insulation is inherently fire safe with a ULC flame-spread rating of 15. Thus, the Fiberglas batts offer this additional advantage over Styrofoam sheets which are not fire rated. The insulation material is moisture resistant in that moisture will not affect the inorganic fibres. However, the Fiberglas insulation batts are water permeable to allow the diffusion of moisture in either direction through the insulation layer.

It is appreciated that several other forms of fibrous-type batts may be used, such as mineral fibrous material and naturally occurring fibrous material which, when compacted, provides the temporary face to which the cementitious material will be applied.

The cementitious, vapour permeable layer applied to the exterior of the fiberglass insulation may be formed of a Portland cement with filler and aggregate. The cementitious material may be modified with a synthetic material to improve its binding characteristics with the fibrous insulation batt and provide a resilient layer. To add to the strength of the material, fibres may be added to the cementitious layer. For example, "AR" (trademark) glass fibres may be added to the cementitious layer. The fibres are chopped strand glass fibres sold by Owens-Corning Fiberglas Corp. of Toledo, Ohio. The glass fibre strengthens the Portland cement which has inherent alkali resistance. As a result, the fibre can add considerably to the structural strength of the cementitious coating and provide a degree of flexibility in the base coating when hardened to avoid development of hairline cracks in the coating due to any movement between the cladding system and the building wall. The various desired properties of fibre reinforced concretes are disclosed in "State of the Art Report on Fibre Reinforced Concrete" ACI Journal/November 1973. An alternate technique for reinforcing this layer involves the use of Fiberglas mesh which is embedded in the applied layer 36 of cementetious material.

A variety of fibre reinforced cementitious coatings are available. For example, the surface bonding cement distributed under the trademark "SHERWALL" by W.R. Bonsal Company of Lyleville, N.C.; "GEMITE" (trademark) fibre reinforced cements manufactured and sold by Gemite Ltd of Ontario, Canada; "FIBREWALL" manufactured and sold by Construmat Inc. of Ontario, Canada are all acceptable, usable forms of fibre reinforce cementitious material. The Fiberwall material sold by Construmat is a synthetic modified cementitious material which includes an acrylic polymer binder material to improve the adhesion characteristics to the fibrous insulation batt and the ability of the hardened base coat to flex to a certain degree in accommodating relative movements with respect to the building wall and not inducing cracks in the finish coat.

The vapor permeable finish coat may include various types of paints or a synthetic layer. The synthetic layer includes a synthetic binder with pebbles, aggregates and the like to present an attractive appearance. To provide a finish coat with a textured finish, the synthetic binder may be an acrylic-styrene polymer composition having elastic properties in combination with filter materials. The acrylic-styrene polymer material may be obtained from many sources, such as that sold under the trademark "ACRONAL" 290D by BASF of West Germany. The acrylic-styrene polymer material is mixed with solvents such as aromatics containing white spirit, butyldigol; butylethanol, butyldigol acetate, pine oils or blends thereof with alcohols, such as methanol, ethanol or isopropanol to improve the freeze/thaw stability. Butyldigol, ethylene glycol and propylene glycol may be added to prevent the finishes from drying too rapidly. Plasticizers, such as dioctyl phthalate, may be added to the finish coat to increase its resiliency. The fillers used with this mixture include aggregate usually ranging in grain size from 1 mm up to 2.5 mm and other fillers such as calcite, wollastonite or mixtures thereof.

These textured finishes are usually premixed at the site. The finished coat is applied to the base coat with a trowel or like device to provide a vapor permeable finish coat. Such premixed finish coat may be obtained from Construmat Inc. of Canada under the trademarks SCRUBBETEX and GRAFFOIATO.

Another form of textured finish coat is available from Rhom and Haas Company under the trademark RHOPLEX MC-76

The vapor permeability of the wall cladding system was tested at 73° F. and 50% relative humidity according to ASTM C3 55-64 "Water Vapor Transmission of Thick Materials". These tests revealed a water vapor permeance averaging from 1 to 1.5 metric perms or from 80 to 130 Ng/Pa.s.m$^2$. The base coat was of the acrylic modified cementitious material. The finish coat was of the synthetic binder-type using an acrylic-styrene polymer mixture.

The significant advantage of this system is that it may be readily applied to an existing building wall while adding considerable insulation value to the existing building wall and at the same time, permitting vapor permeance from within the building to the outside particularly during cold seasons, when the exterior of the building wall is considerably colder than the interior of the building wall.

By use of a sufficient number of fasteners, the hardened base coat and finish coat are suspended from the building wall. It has been found that approximately one fastener or more per one and one half square feet of applied insulation is required to adequately support and suspend the cementitious base coat and finish coat from the building exterior. Preferably, at least one fastener is used for every square foot of insulation applied. The fibrous insulation does not serve to provide any appreciable support to the outer wall, since the load is taken up by the fastener plates. The fibrous structure of the insulation layer permits movement of the outer wall relative to the building wall due to expansion and contraction of the cladding system relative to the building wall caused by extremes in temperatures. This minimizes cracking of the cladding exterior, because the fibrous insulation can readily separate itself from the hardened base coat without affecting the exterior surface. Furthermore, the fibrous insulation has a degree of compressibility should expansion occur between the cladding finish coat and the building exterior. Therefore, the fibrous insulation batts provide a temporary surface to which the cementitious base coat is applied. Once the cementitious base coat is hardened, the surface of the insulation batts is no longer used in providing the support of the wall cladding exterior relative to the pre-existing building exterior.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A method for applying a suspended, insulated building exterior cladding system comprising affixing a plurality of batts of semi-rigid, vapor permeable, fibrous insulation over an existing building exterior surface to be covered with said cladding system, said plurality of batts abutting one another as applied to provide an essentially continuous insulated layer on said building exterior surface, said step of affixing said plurality of batts comprising the use of fasteners extending through each said insulation batt to secure each said battt to said building exterior surface, each of said fasteners being firmly secured to said building exterior surface and being of sufficient length to preclude over-compression of each of said batts, a fastener head portion has a rigid plate connected thereto where said rigid plate includes a plurality of apertures extending therethrough, applying over said affixed plurality of batts a continuous layer of cementitious material which hardens when set, forcing said cementitious material through the apertures in each said plate adjacent said fasteners, allowing said applied cementitious layer to harden to secure thereby said hardened cementitious layer to said fastener rigid plates, and applying a vapor permeable finish coat to said cementitious layer, said hardened layer being vapor permeable, in said step of affixing said plurality of batts, a sufficient number of said fastener rigid plates being used to suspend in a cantilever manner said hardened cementitious layer from said building exterior surface independent of said fibrous insulation layer to accommodate thereby expansion and contraction movements in said fibrous insulation without cracking said hardened cementitious layer.

2. A method of claim 1, wherein said cementitious layer is trowel applied to level out any undulations in the affixed batts of insulation, said insulation batts providing a temporary supporting surface to which said cementitious layer is applied, said insulation batts providing for movement between their interfaces with the hardened continuous cementitious layer, each of said batts of insulation being of glass fibre having a controlled density and thickness bonded by a thermosetting resin to provide rigidity of form.

3. A method of claim 2, wherein at least one fastener is used for approximately every one and one half square feet of insulation applied.

4. A method of claim 1, wherein said cementitious or like layer comprises a fibre reinforced concrete Portland cement.

5. A method of claim 4, wherein said cement is modified with the addition of a synthetic binder in the form of an acrylic material before application of said layer.

6. A method of claim 4, wherein said fibre used to reinforce said concrete comprises glass, steel, plastic and natural fibres.

7. A method of claim 1, wherein said vapor permeable finish coat is applied using a synthetic binder consisting of acrylic-styrene polymer composition in combination with a filler.

8. A method of claim 1, wherein said finish coat is a vapor permeable paint.

9. A method of claim 7, wherein an aggregate is added to said binder.

* * * * *